US011285743B2

(12) United States Patent
Oguchi et al.

(10) Patent No.: US 11,285,743 B2
(45) Date of Patent: Mar. 29, 2022

(54) PRINTER

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP); Masahiro Tsuchiya, Tokyo (JP); Yuji Yada, Tokyo (JP); Tetsuhiro Ishikawa, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 18 days.

(21) Appl. No.: 15/754,085

(22) PCT Filed: Aug. 30, 2016

(86) PCT No.: PCT/JP2016/075262
§ 371 (c)(1),
(2) Date: Feb. 21, 2018

(87) PCT Pub. No.: WO2017/043361
PCT Pub. Date: Mar. 16, 2017

(65) Prior Publication Data

US 2018/0250962 A1 Sep. 6, 2018

(30) Foreign Application Priority Data

Sep. 9, 2015 (JP) ..... JP2015-177970

(51) Int. Cl.
*B41J 15/04* (2006.01)
*B41J 2/32* (2006.01)
*B41J 11/70* (2006.01)

(52) U.S. Cl.
CPC ..... *B41J 15/04* (2013.01); *B41J 2/32* (2013.01); *B41J 11/70* (2013.01); *B41J 15/042* (2013.01)

(58) Field of Classification Search
CPC ..... B41J 2/32; B41J 11/71; B41J 15/04; B41J 11/70; B41J 15/042
See application file for complete search history.

(56) References Cited

U.S. PATENT DOCUMENTS

| | | | |
|---|---|---|---|
| 6,744,457 | B2 | 6/2004 | Seino et al. |
| 7,806,361 | B2 | 10/2010 | Sato et al. |
| 8,585,304 | B2 | 11/2013 | Yokoyama |
| 9,079,438 | B1 | 7/2015 | Ishikawa et al. |
| 2010/0086341 | A1 | 4/2010 | Yokoyama et al. |

(Continued)

FOREIGN PATENT DOCUMENTS

| | | |
|---|---|---|
| CN | 104417092 | 3/2015 |
| CN | 104875508 | 9/2015 |

(Continued)

*Primary Examiner* — Matthew G Marini
*Assistant Examiner* — Marissa Ferguson-Samreth
(74) *Attorney, Agent, or Firm* — IPUSA, PLLC

(57) ABSTRACT

A printer includes a printer body (110) including a recording-paper holder (111) that holds rolled recording paper (100) and includes a holder guide (112) for guiding the recording paper (100), a platen roller (140), a print head (130) attached to the printer body (110), and a lower guide (160) that is disposed to face the holder guide (112) such that a conveying path for guiding the recording paper (100) is formed between the lower guide (160) and the holder guide (112).

6 Claims, 22 Drawing Sheets

(56) References Cited

U.S. PATENT DOCUMENTS

| | | | | |
|---|---|---|---|---|
| 2015/0061206 | A1* | 3/2015 | Takabatake | B26D 1/085<br>270/1.01 |
| 2015/0092003 | A1* | 4/2015 | Ishii | B41J 15/042<br>347/220 |

FOREIGN PATENT DOCUMENTS

| | | | | |
|---|---|---|---|---|
| EP | 2343192 | * | 7/2011 | B26D 1/085 |
| EP | 2842757 | * | 4/2017 | B26D 1/085 |
| JP | H02-081853 | | 3/1990 | |
| JP | H02-160558 | | 6/1990 | |
| JP | 10235952 | * | 9/1998 | B41J 11/38 |
| JP | H10-235952 | | 9/1998 | |
| JP | 2003-246104 | | 9/2003 | |
| JP | 2008-143004 | | 6/2008 | |
| JP | 2008-210097 | | 9/2008 | |
| JP | 2009-028910 | | 2/2009 | |
| JP | 2010-089330 | | 4/2010 | |
| JP | 2011-51354 | * | 3/2011 | B41J 11/00 |
| WO | 2016110921 | * | 7/2016 | B41J 11/70 |

* cited by examiner

PRINTER

TECHNICAL FIELD

An aspect of the present invention relates to a printer.

BACKGROUND ART

Printers for printing receipts are widely used, for example, for cash registers in shops, automated teller machines (ATM), and cash dispensers (CD). In such a printer, information is printed on recording paper by a print head while the recording paper is being fed, and the recording paper is cut by a cutter. The cutter includes a fixed blade and a movable blade, and the movable blade slides toward the fixed blade to cut the recording paper.

Also, there is a printer that includes a printer body and a cover rotatably supported by the printer body. When the cover is opened, rolled recording paper can be placed in the printer body.

RELATED-ART DOCUMENTS

Patent Documents

[Patent Document 1] Japanese Patent No. 2585769

[Patent Document 2] Japanese Laid-Open Patent Publication No. 2003-246104

[Patent Document 3] Japanese Laid-Open Patent Publication No. 2009-028910

[Patent Document 4] Japanese Laid-Open Patent Publication No. 2008-143004

SUMMARY OF INVENTION

Technical Problem

A printer is also employed for a device such as a ticketing device used by anonymous users. When recording paper is jammed while a user is using a ticketing device, the user may try to pull out a portion of the recording paper that has been output from the ticketing device and on which information has been partially printed. When the recording paper is pulled in the middle of printing, a force is applied to the recording paper in a direction diagonal to the width direction of the recording paper, and the recording paper is sandwiched between a thermal head and a platen roller in an inclined orientation and warped. As a result, when printing is performed later, the recording paper may be jammed again.

For the above reasons, there is a demand for a printer where recording paper is not jammed.

Solution to Problem

In an aspect of this disclosure, there is provided a printer that includes a printer body including a recording-paper holder that holds rolled recording paper and includes a holder guide for guiding the recording paper, a platen roller, a print head attached to the printer body, and a lower guide that is disposed to face the holder guide such that a conveying path for guiding the recording paper is formed between the lower guide and the holder guide.

Advantageous Effects of Invention

An aspect of the present invention makes it possible to prevent recording paper from being jammed in a printer.

DESCRIPTION OF EMBODIMENTS

Embodiments of the present invention are described below with reference to the accompanying drawings. Throughout the drawings, the same reference number is assigned to the same component, and repeated descriptions of the same component are omitted.

Figure 1:
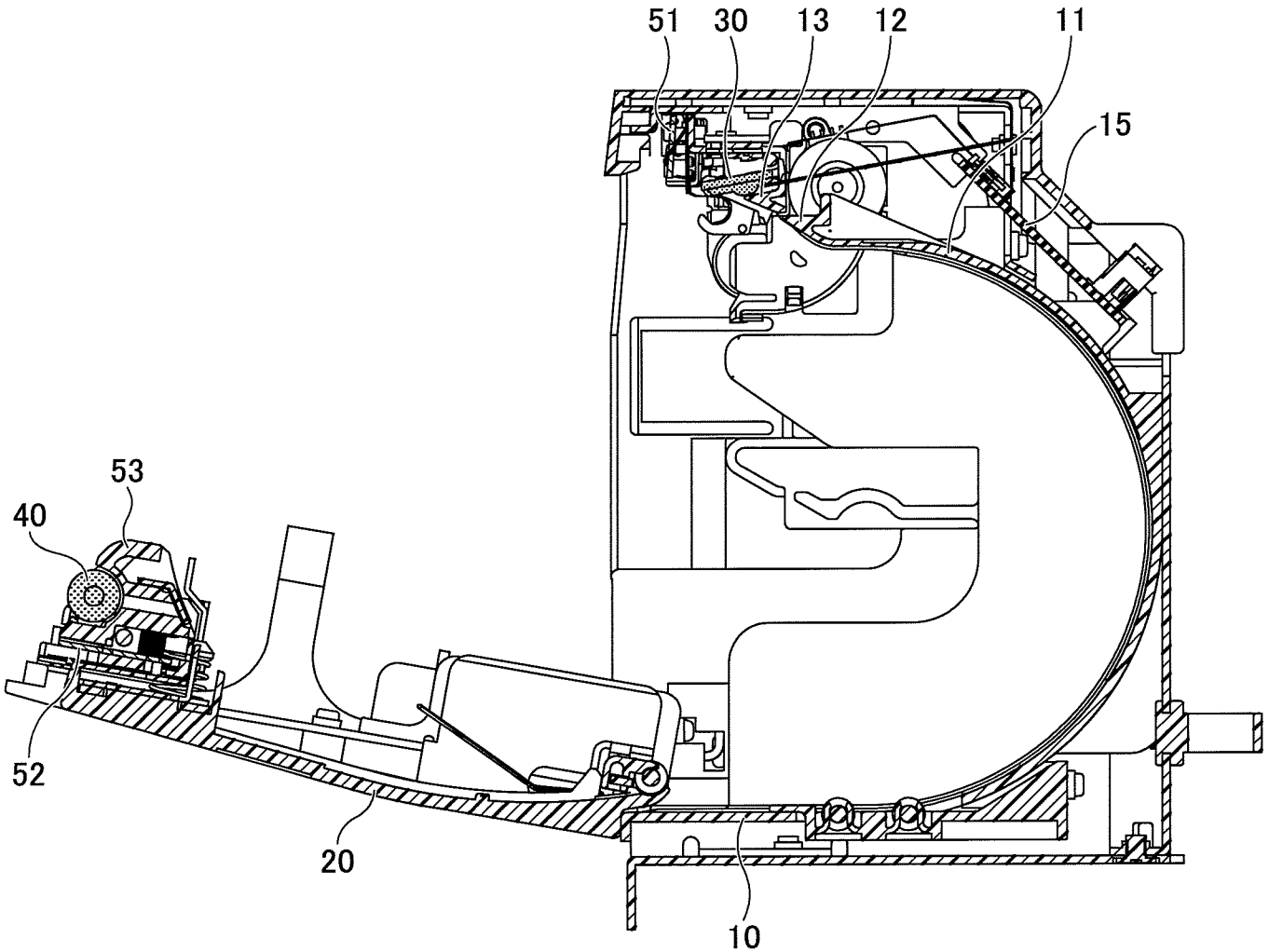
FIG. 1 is a cross-sectional view of a printer whose cover is open.
Figure 2:
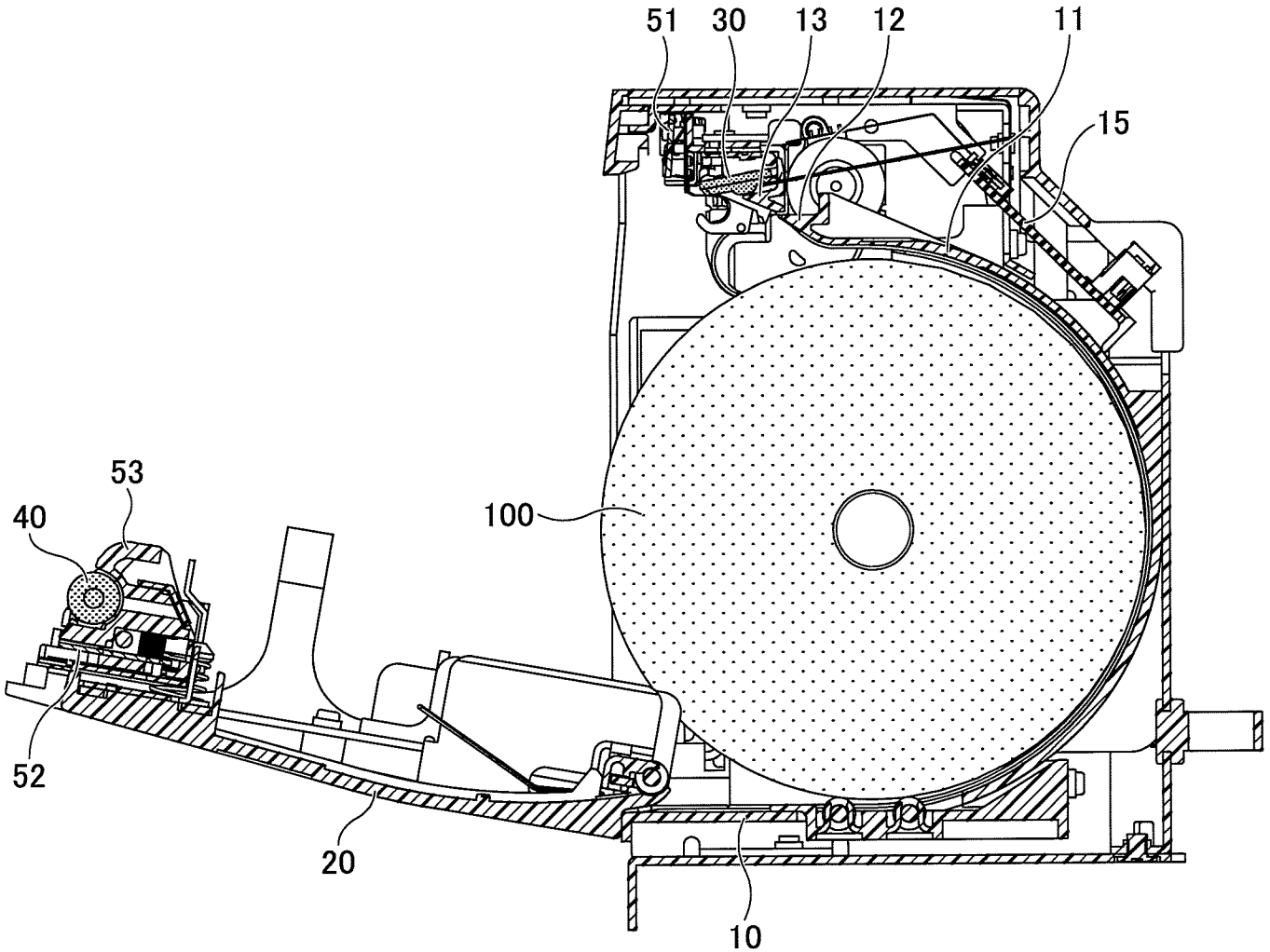
FIG. 2 is a cross-sectional view of the printer whose cover is open.
Figure 3:
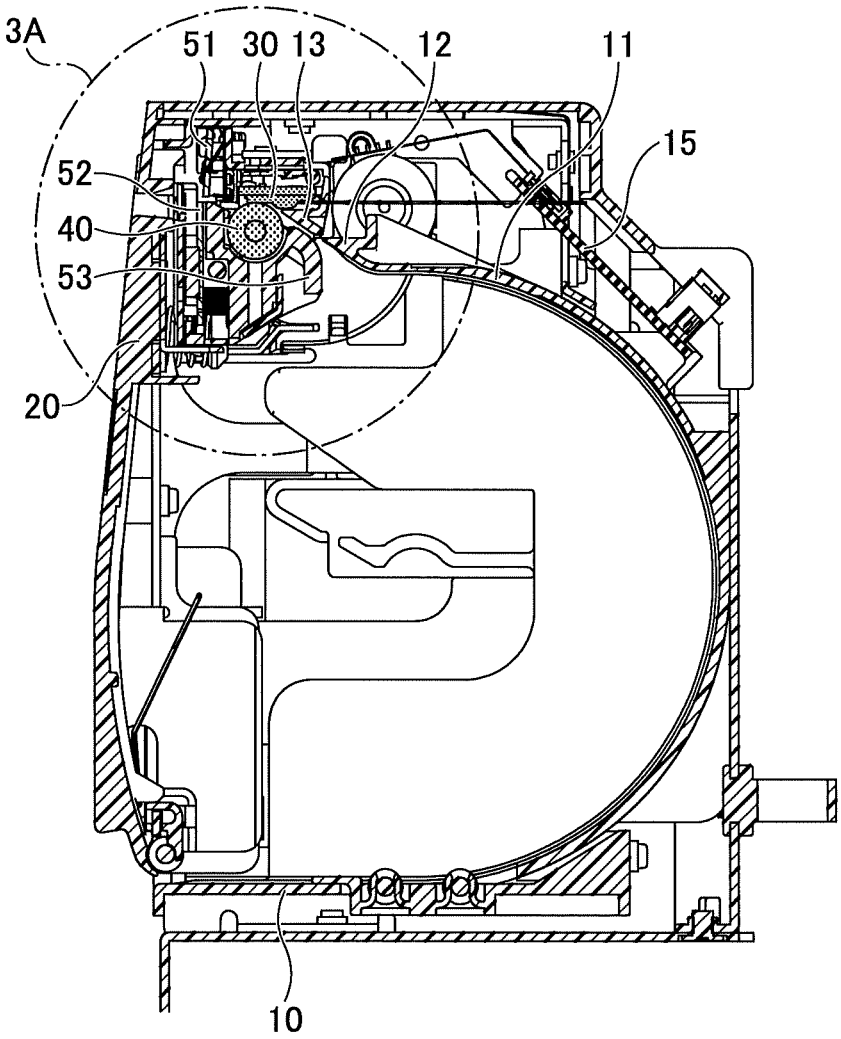
FIG. 3 is a cross-sectional view of the printer whose cover is closed.
Figure 4:
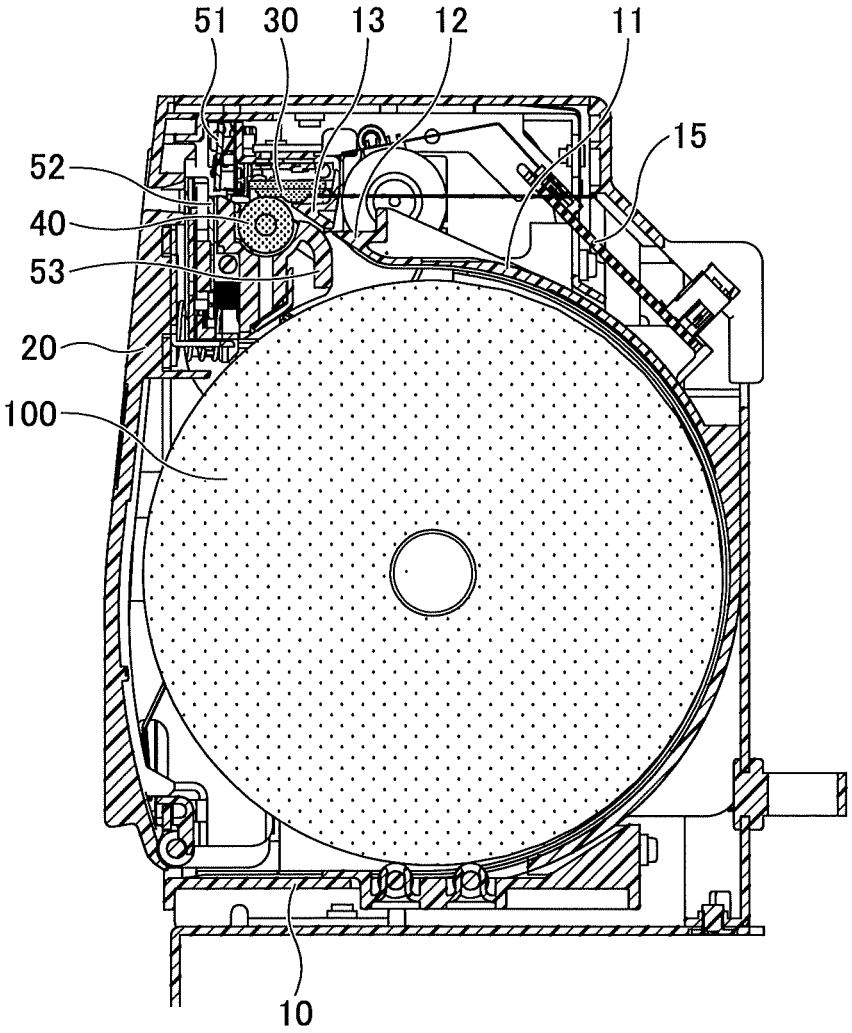
FIG. 4 is a cross-sectional view of the printer whose cover is closed.
Figure 5:
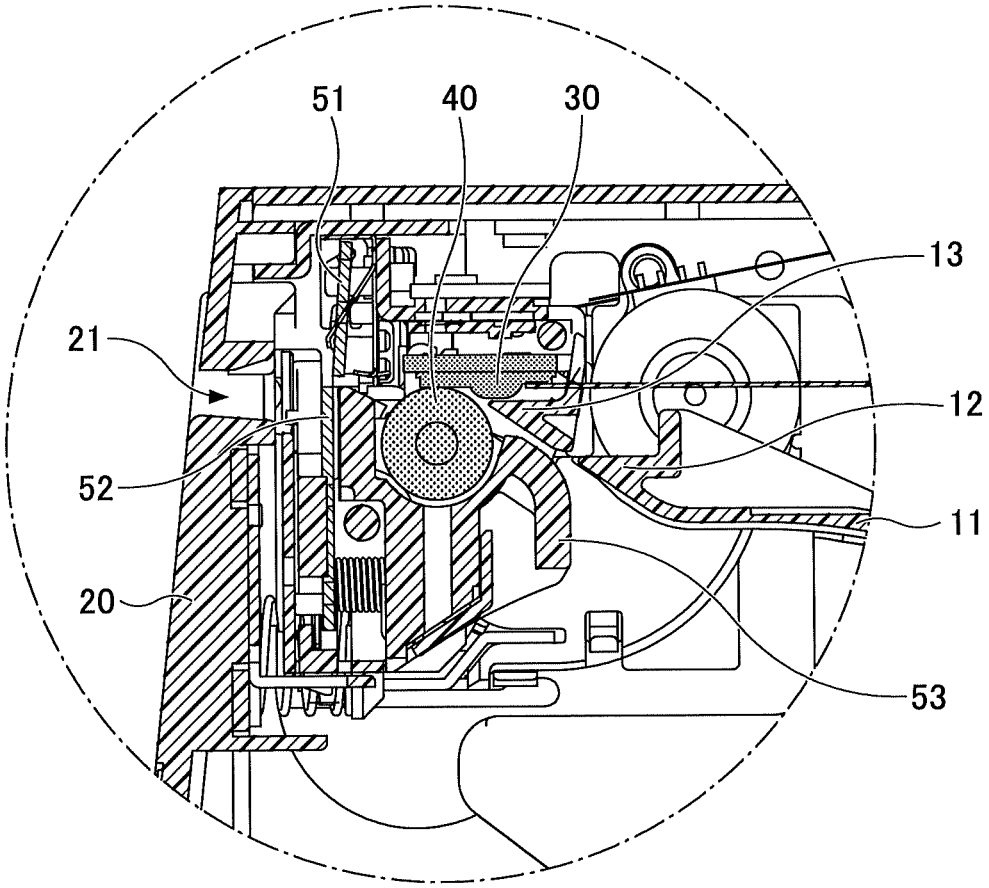
FIG. 5 is a partial enlarged view of the printer.

First, a printer illustrated in FIGS. 1 through 5 is described. The printer illustrated in FIGS. 1 through 5 may be referred to as a clamshell printer and is configured such that rolled recording paper is placed in a recording-paper holder using a drop-in mechanism. FIGS. 1 and 2 are cross-sectional views of the printer whose cover is open. FIG. 1 illustrates a state where no recording paper is placed in the recording-paper holder, and FIG. 2 illustrates a state where recording paper is placed in the recording-paper holder. FIGS. 3 and 4 are cross-sectional views of the printer whose cover is closed. FIG. 3 illustrates a state where no recording paper is placed in the recording-paper holder, and FIG. 4 illustrates a state where recording paper is placed in the recording-paper holder. FIG. 5 is an enlarged view of an area surrounded by a dashed-dotted line 3A in FIG. 3.

The printer illustrated in FIGS. 1 through 5 includes a printer body 10 and a cover 20 that is rotatably attached to the printer body 10.

A recording-paper holder 11, a thermal head 30, a fixed blade 51, a control circuit board 15, and motors are provided in the printer body 10. The recording-paper holder 11 is formed such that rolled recording paper 100 can be placed inside of the recording-paper holder 11.

The recording-paper holder 11 includes a holder guide 12 for guiding the recording paper 100 toward the thermal head 30. An upper guide 13 for guiding the recording paper 100 is provided between the thermal head 30 and the holder guide 12. The control circuit board 15 is for controlling the printer illustrated in FIGS. 1 through 5. The motors include a motor for conveying the recording paper 100 and a motor for driving the movable blade 52.

A platen roller 40, a movable blade 52, and a cutter frame 53 are provided on the cover 20.

The rolled recording paper 100 is placed in the recording-paper holder 11. The fixed blade and the movable blade 52 form a cutter for cutting the recording paper 100. The movable blade 52 slides toward the fixed blade 51 to cut the recording paper 100.

Figure 6:
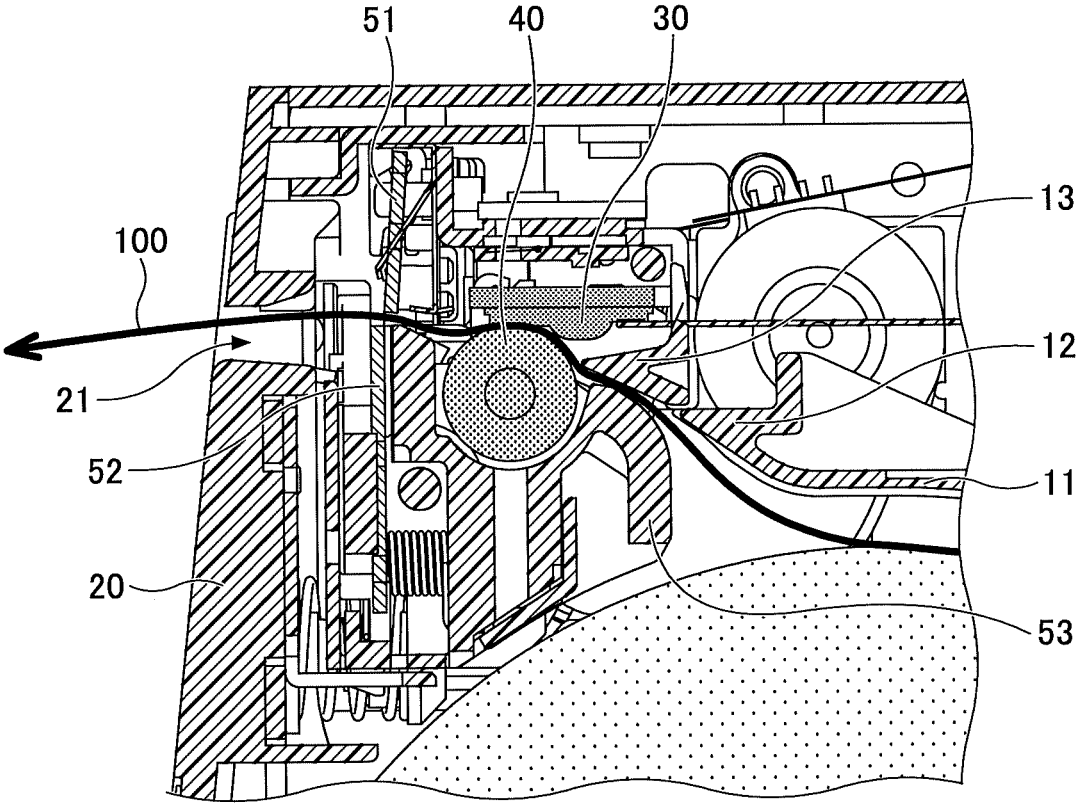
FIG. 6 is a drawing illustrating a path in the printer through which recording paper is conveyed.

As illustrated in FIG. 6, when printing is performed on the recording paper 100, the recording paper 100 passes through a conveying path between the holder guide 12 and the cutter frame 53, passes between the upper guide 13 and the cutter frame 53, and is then sandwiched between the thermal head 30 and the platen roller 40. The recording paper 100 is conveyed by rotation of the platen roller 40, and the thermal head 30 prints information on the recording paper 100 while the recording paper 100 is being conveyed. After information is printed, the recording paper 100 passes between the fixed blade 51 and the movable blade 52, and is ejected through a paper-ejection port 21 formed in the cover 20.

Figure 7:
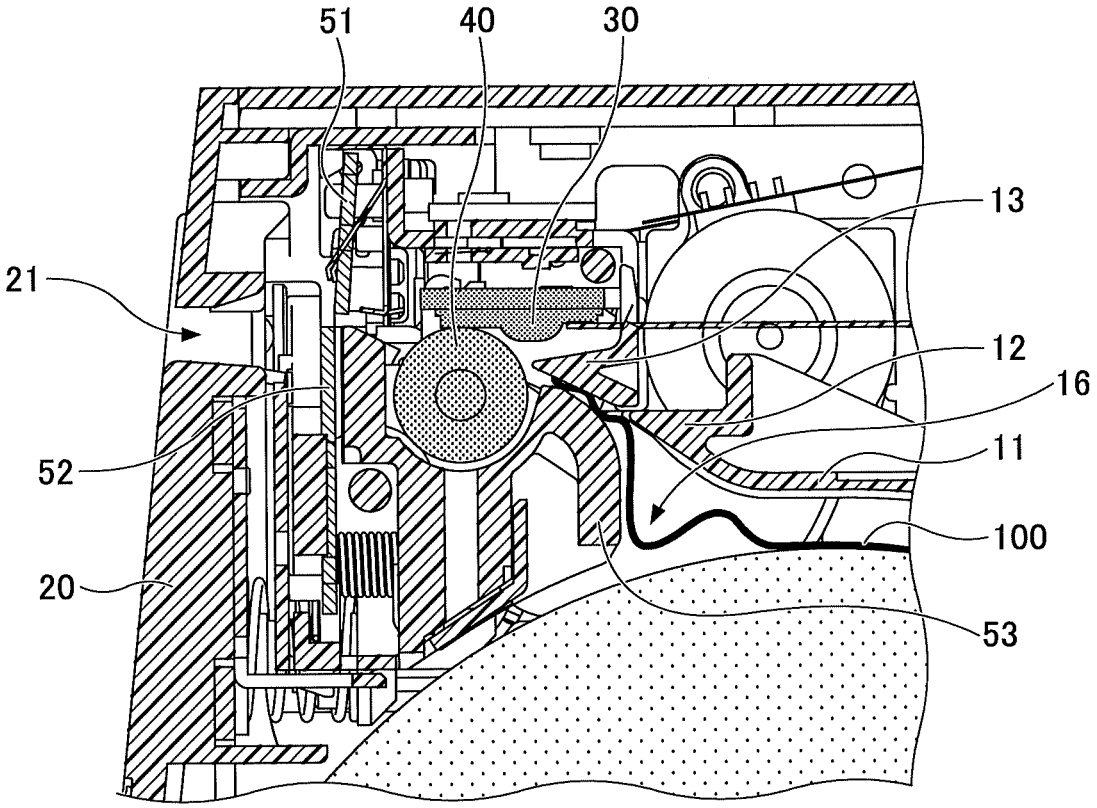
FIG. 7 is a drawing illustrating recording paper jammed in the printer.

As illustrated in FIG. 6, even in the middle of printing, a portion of the recording paper 100 on which information has already been printed is located outside of the paper-ejection port 21. There may be a case where a user pulls the portion of the recording paper 100 located outside of the paper-ejection port 21 while information is being printed on the recording paper 100 and before the recording paper 100 is cut by the cutter. Depending on the manner in which the user pulls the recording paper 100, a force may be applied to the recording paper 100 in a direction diagonal to the width direction of the recording paper 100, and the recording paper 100 may be sandwiched between the thermal head 30 and the platen roller 40 in an orientation inclined with respect to the width direction. In such a case, the recording paper 100 may not be normally conveyed thereafter, and as illustrated in FIG. 7, the recording paper 100 may warp in a space 16 between the holder guide 12 and the cutter frame 53 and be jammed. The jammed recording paper 100 needs to be removed, and the printer cannot be used until the recording paper 100 is removed.

First Embodiment

Figure 8:
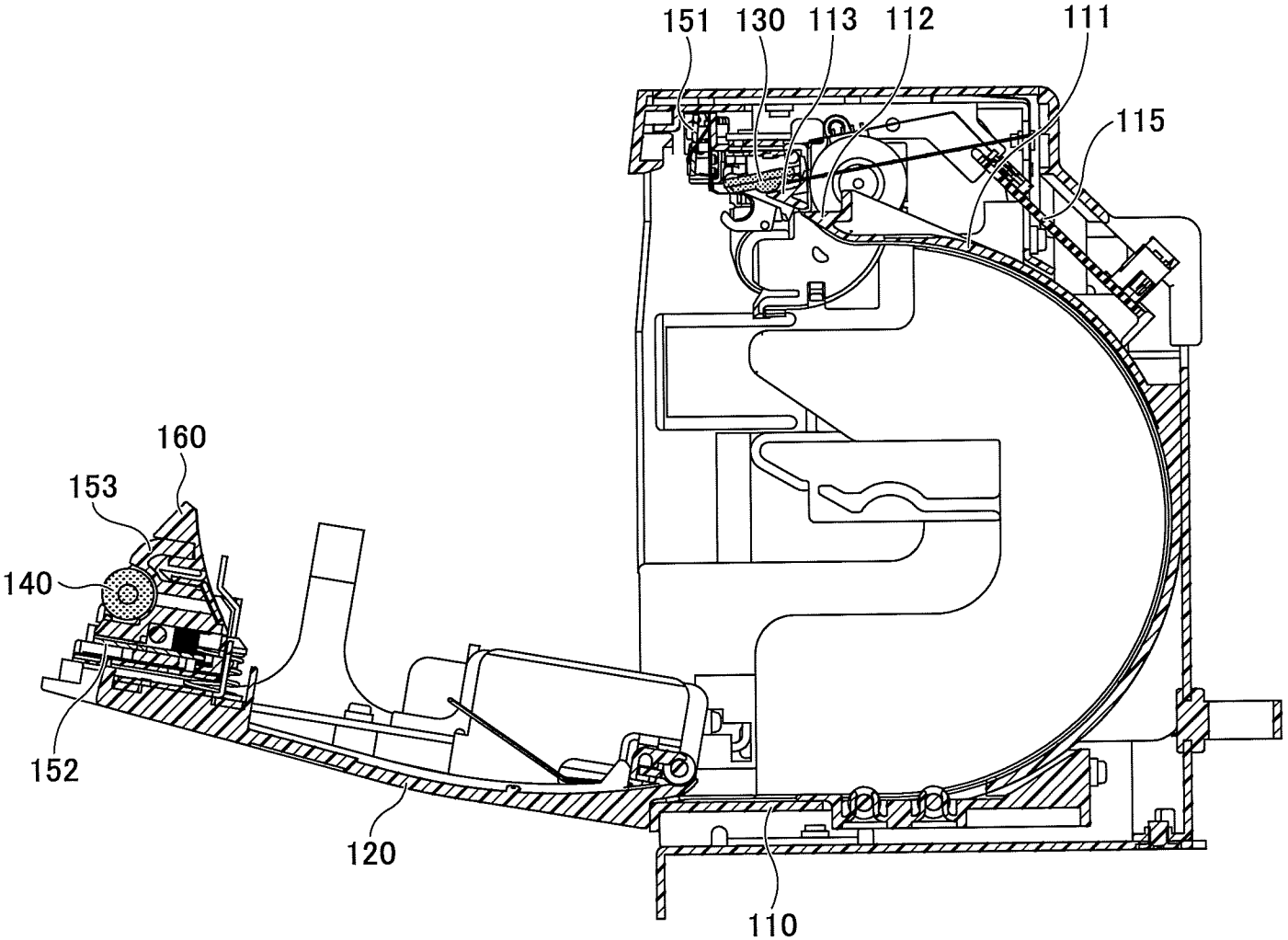
FIG. 8 is a cross-sectional view of a printer of a first embodiment whose cover is open.
Figure 9:
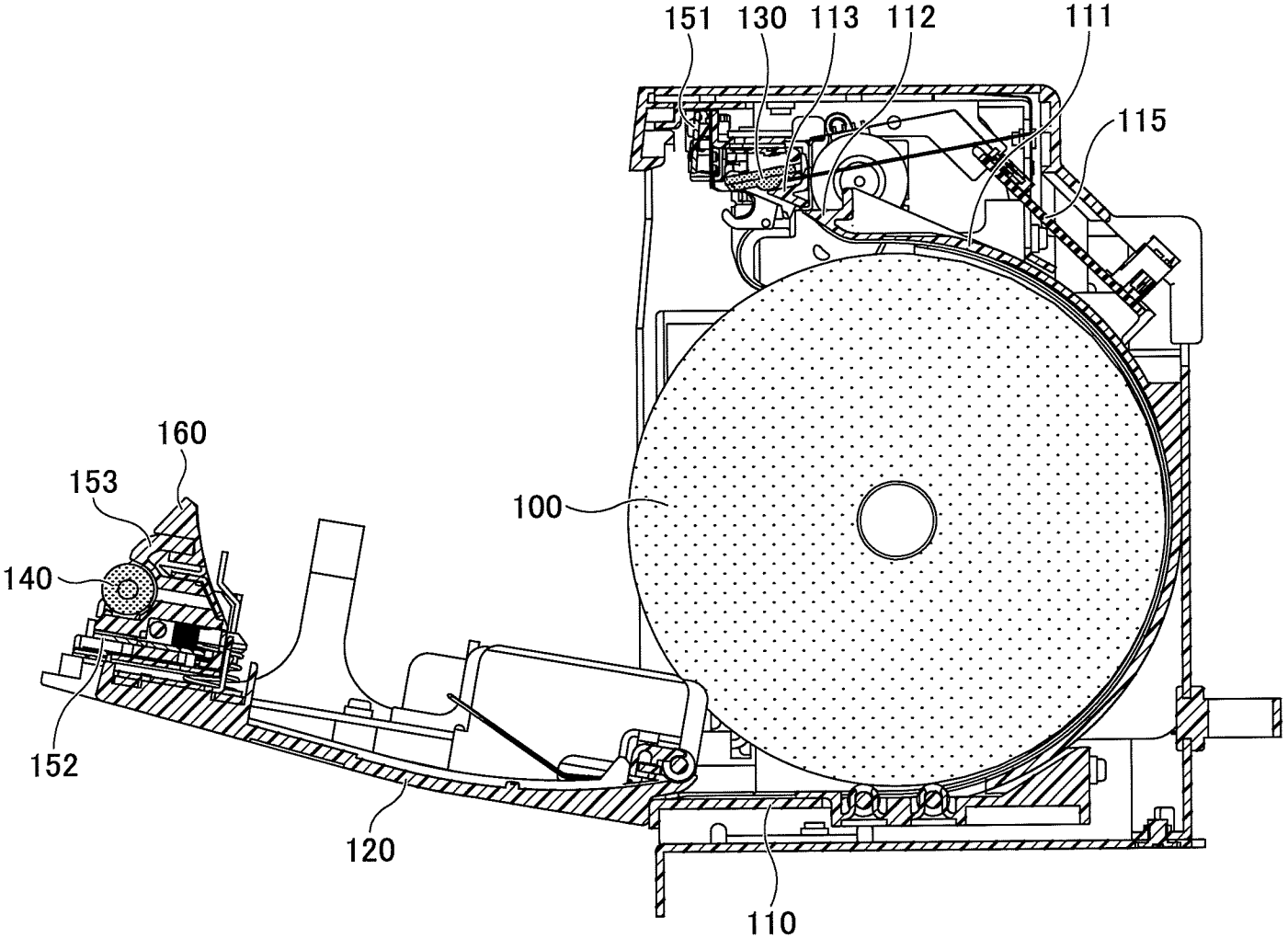
FIG. 9 is a cross-sectional view of the printer of the first embodiment whose cover is open.
Figure 10:
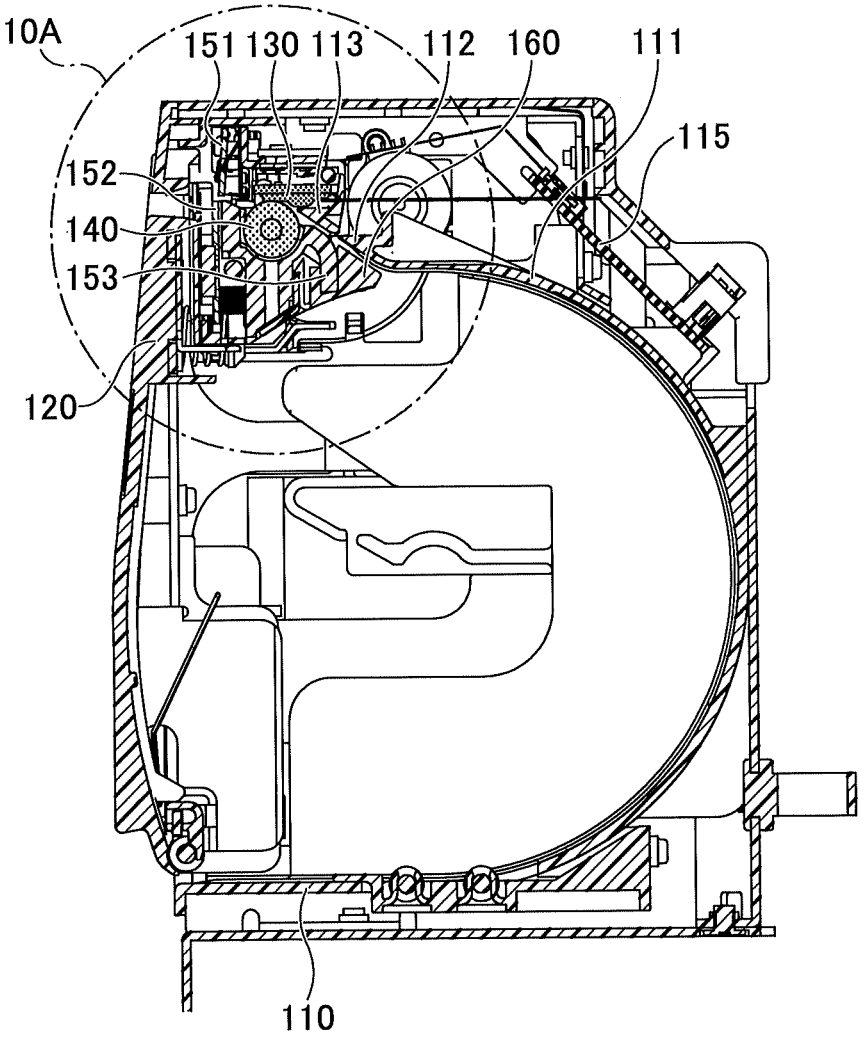
FIG. 10 is a cross-sectional view of the printer of the first embodiment whose cover is closed.
Figure 11:
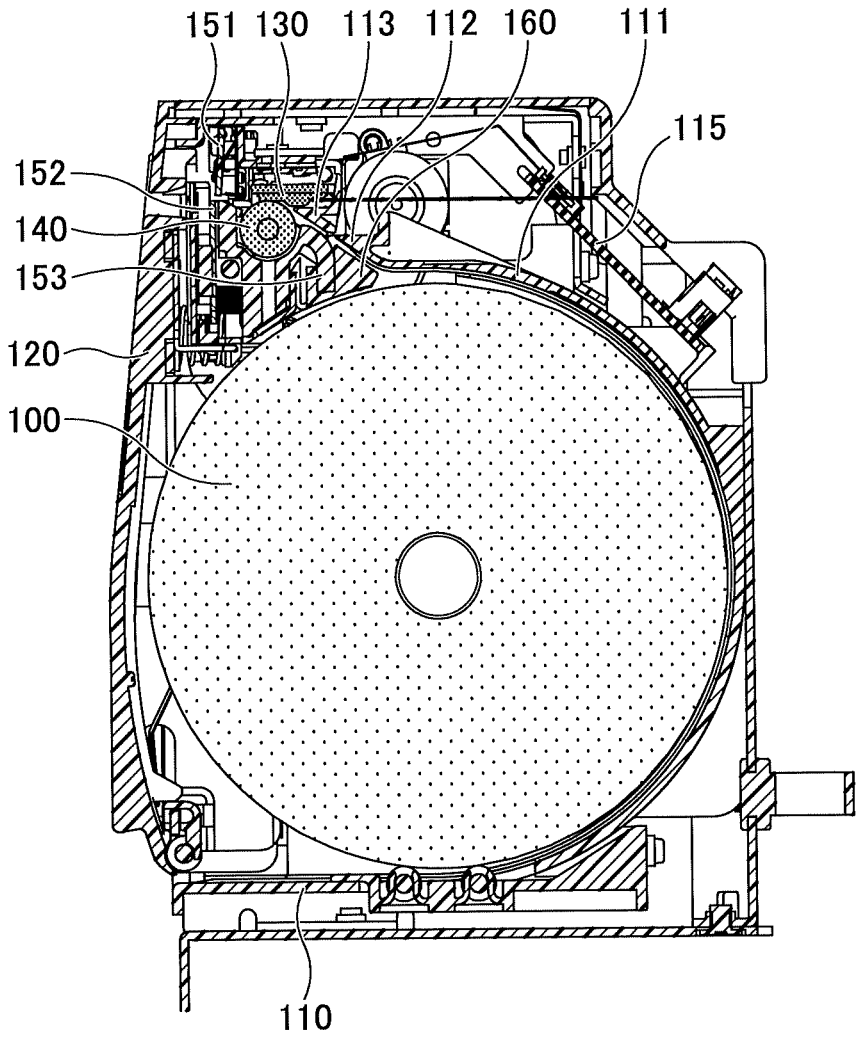
FIG. 11 is a cross-sectional view of the printer of the first embodiment whose cover is closed.
Figure 12:
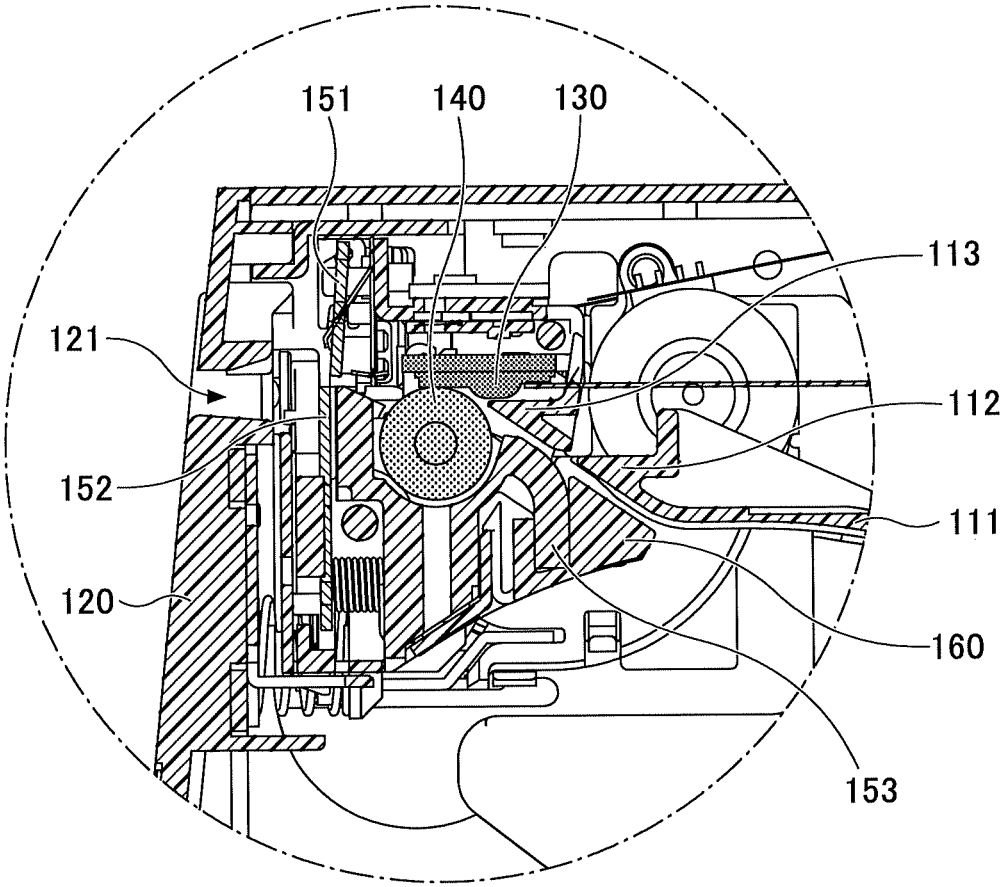
FIG. 12 is a partial enlarged view of the printer of the first embodiment.
Figure 13:
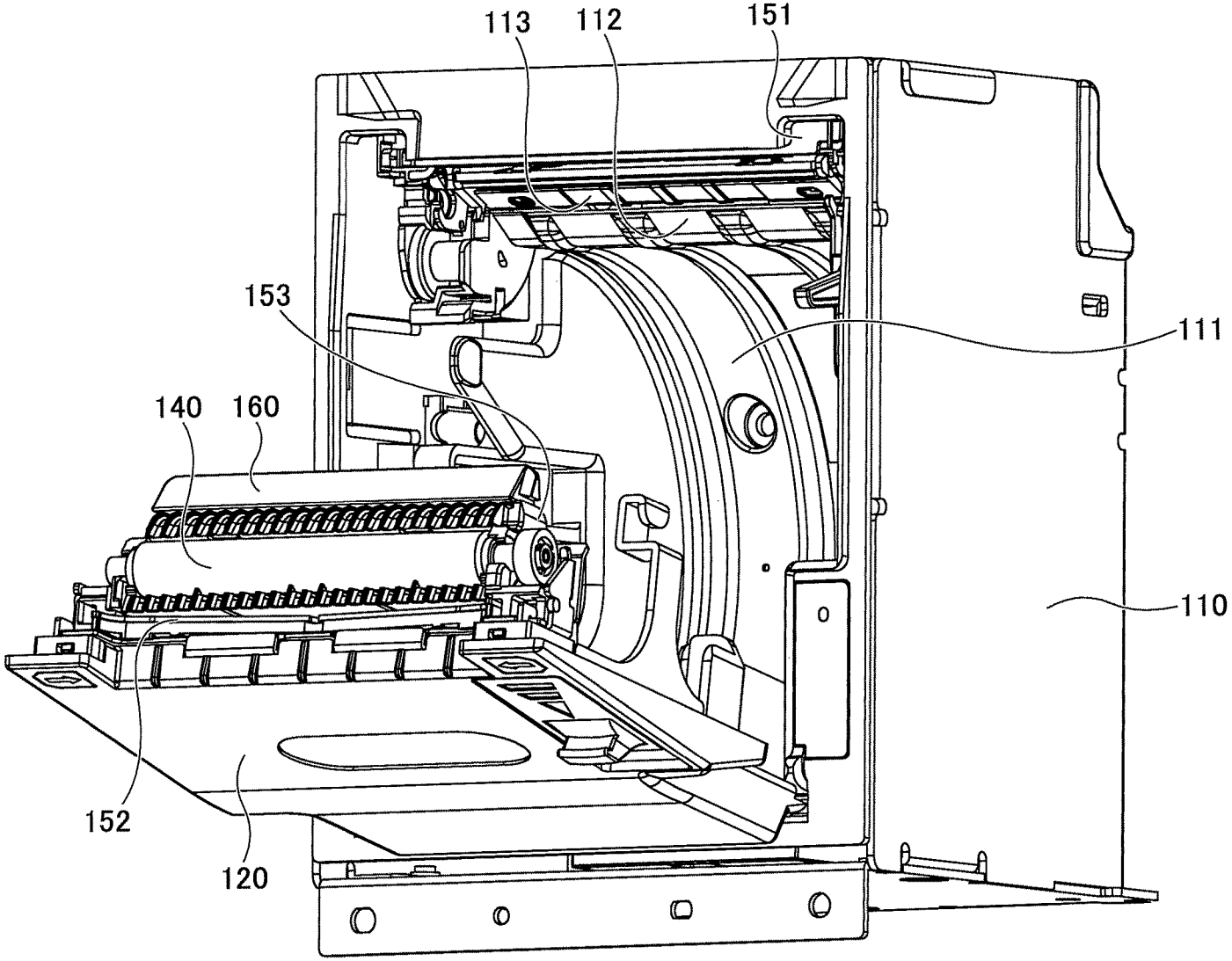
FIG. 13 is a perspective view of the printer of the first embodiment whose cover is open.

Next, a printer according to a first embodiment is described with reference to FIGS. 8 through 13. Similarly to the printer of FIG. 1, the printer of the first embodiment is a clamshell printer configured such that rolled recording paper is placed in a recording-paper holder using a drop-in mechanism. FIGS. 8 and 9 are cross-sectional views of the printer of the first embodiment whose cover is open. FIG. 8 illustrates a state where no recording paper is placed in the recording-paper holder, and FIG. 9 illustrates a state where recording paper is placed in the recording-paper holder. FIGS. 10 and 11 are cross-sectional views of the printer of the first embodiment whose cover is closed. FIG. 10 illustrates a state where no recording paper is placed in the recording-paper holder, and FIG. 11 illustrates a state where recording paper is placed in the recording-paper holder. FIG. 12 is an enlarged view of an area surrounded by a dashed-dotted line 10A in FIG. 10. FIG. 13 is a perspective view of the printer whose cover is open and where no recording paper is placed in the recording-paper holder.

The printer of the first embodiment includes a printer body 110 and a cover 120. The cover 120 is attached to the printer body 110 such that the cover 120 is rotatable, openable, and closable.

A recording-paper holder 111, a thermal head 130 that is a print head for printing information on the recording paper 100, a fixed blade 151, a control circuit board 115, and motors are provided in the printer body 110. The recording-paper holder 111 is formed such that rolled recording paper 100 can be placed inside of the recording paper holder 111. In the first embodiment, the recording paper 100 is thermal paper.

The recording paper holder 111 includes a holder guide 112 for guiding the recording paper 100 toward the thermal head 130. An upper guide 113 for guiding the recording paper 100 is provided between the thermal head 130 and the holder guide 112. The control circuit board 115 is for controlling the printer of the first embodiment. The motors include a motor for conveying the recording paper 100 and a motor for driving the movable blade 152.

Figure 14:
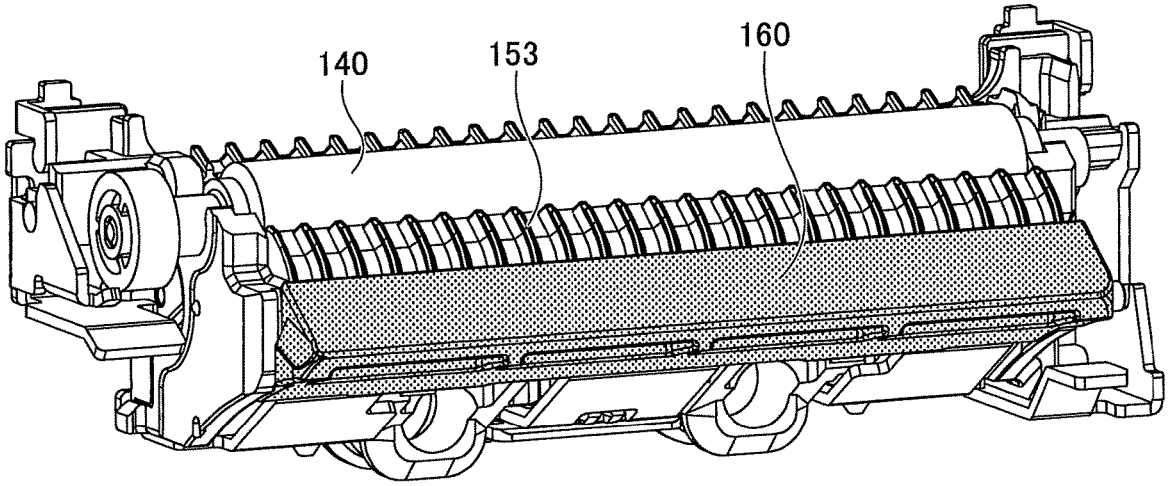
FIG. 14 is a perspective view of a cutter frame to which a lower guide is attached.
Figure 15:
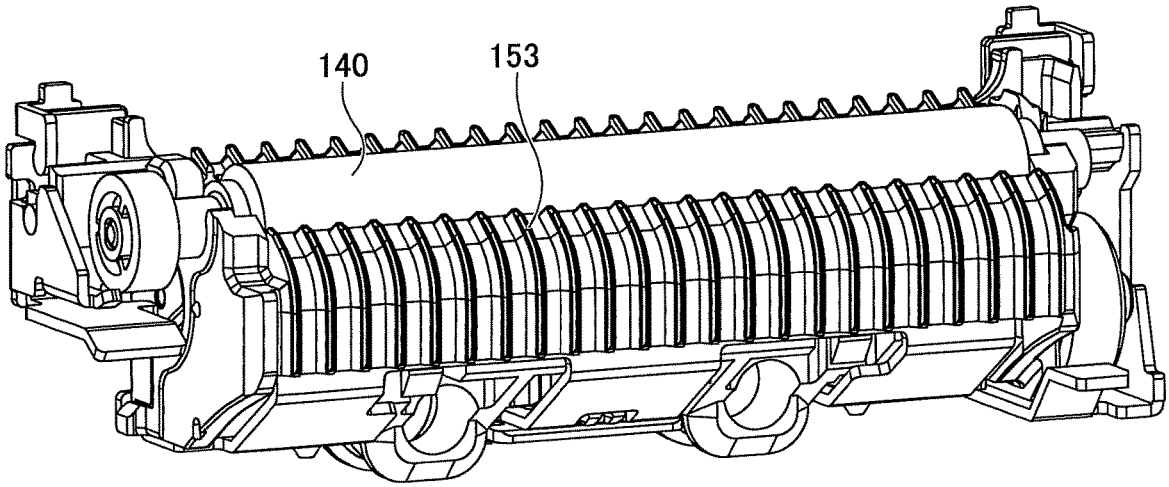
FIG. 15 is a perspective view of the cutter frame to which the lower guide is not attached.

A platen roller 140 and a cutter frame 153 including a movable blade 152 are provided on the cover 120. A lower guide 160 is attached to the cutter frame 153. The lower guide 160 faces the holder guide 112 and forms a conveying path through which the recording paper 100 is conveyed. FIG. 14 illustrates the cutter frame 153 to which the lower guide 160 is attached, and FIG. 15 illustrates the cutter frame 153 to which the lower guide 160 is not attached.

In the first embodiment, the recording paper 100 is set in the printer by placing the recording paper 100 in the recording-paper holder 111 and closing the cover 120. The fixed blade 151 provided in the printer body 110 and the movable blade 152 provided on the cover 120 form a cutter for cutting the recording paper 100. The movable blade 152 slides toward the fixed blade 151 to cut the recording paper 100 between the fixed blade 151 and the movable blade 152.

Figure 16:
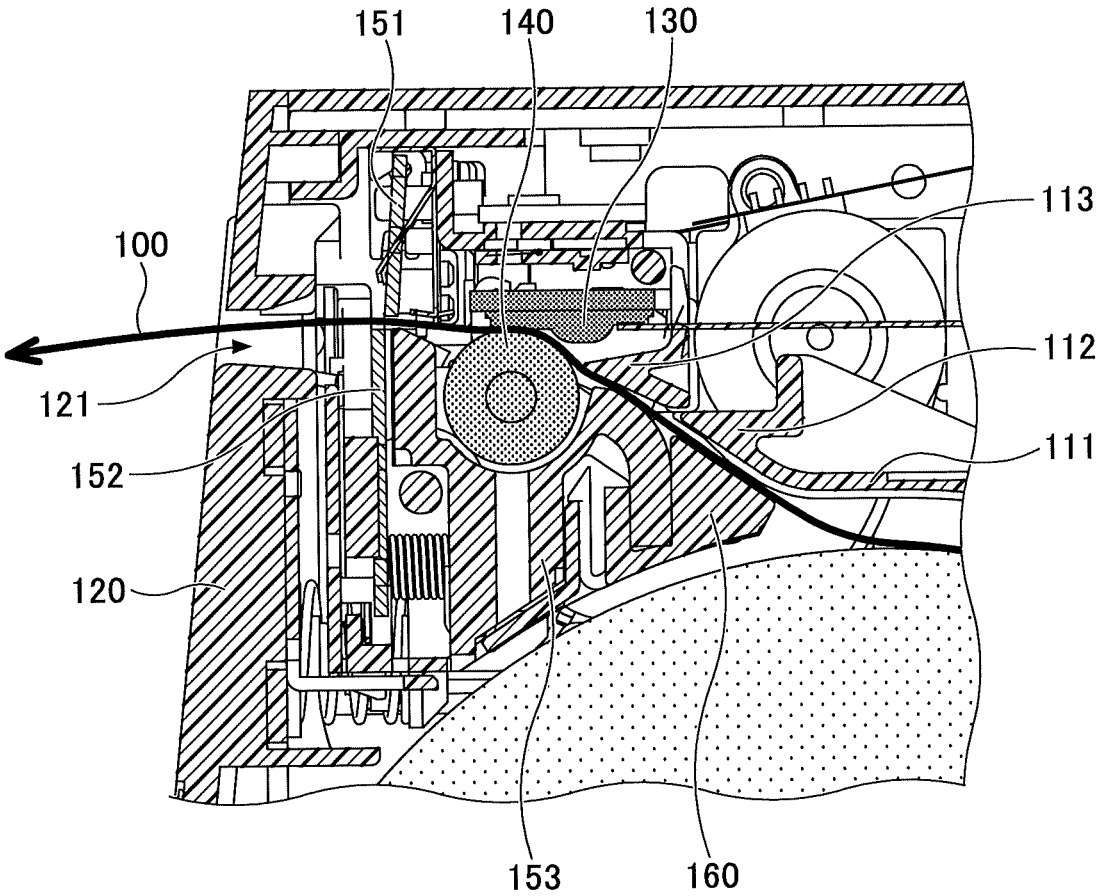
FIG. 16 is a drawing illustrating a path in the printer of the first embodiment through which recording paper is conveyed.

As illustrated in FIG. 16, when printing is performed on the recording paper 100, the recording paper 100 passes between the lower guide 160 and the holder guide 112 formed at an end of the recording-paper holder 111, passes between the upper guide 113 and the cutter frame 153, and is then sandwiched between the thermal head 130 and the platen roller 140. That is, the holder guide 112 and the lower guide 160 form a conveying path through which the recording paper 100 is conveyed. The recording paper 100 is conveyed by rotation of the platen roller 140, and the thermal head 130 prints information on the recording paper 100 while the recording paper 100 is being conveyed. A portion of the recording paper 100 on which information has been printed passes between the fixed blade 151 and the movable blade 152, and is ejected through a paper-ejection port 121 formed in the cover 120.

Also with the printer of the present embodiment, even in the middle of printing, a portion of the recording paper 100 on which information has already been printed may be located outside of the paper-ejection port 121. Also in the present embodiment, when a user pulls the portion of the recording paper 100 located outside of the paper-ejection port 121 while information is being printed on the recording paper 100 and before the recording paper 100 is cut by the cutter, a force is applied to the recording paper 100 in a direction diagonal to the width direction of the recording paper 100. In the first embodiment, however, because the lower guide 160 is provided to face the holder guide 112 and form a conveying path, the space 16 as illustrated in FIG. 7 is not present. Accordingly, in the printer of the first embodiment, even when a user pulls a portion of the recording paper 100 located outside of the paper-ejection port 121 in the middle of printing, the recording paper 100 passes through a relatively-narrow conveying path formed between the holder guide 112 and the lower guide 160, and the lower surface of the recording paper 100 is guided by the lower guide 160. With this configuration, even if the recording paper 100 is not normally conveyed, the warping of the recording paper 100 in a position where the lower guide 160 is formed can be reduced. Accordingly, the configuration of the first embodiment can prevent the recording paper 100 from being jammed in the printer.

Figure 17:
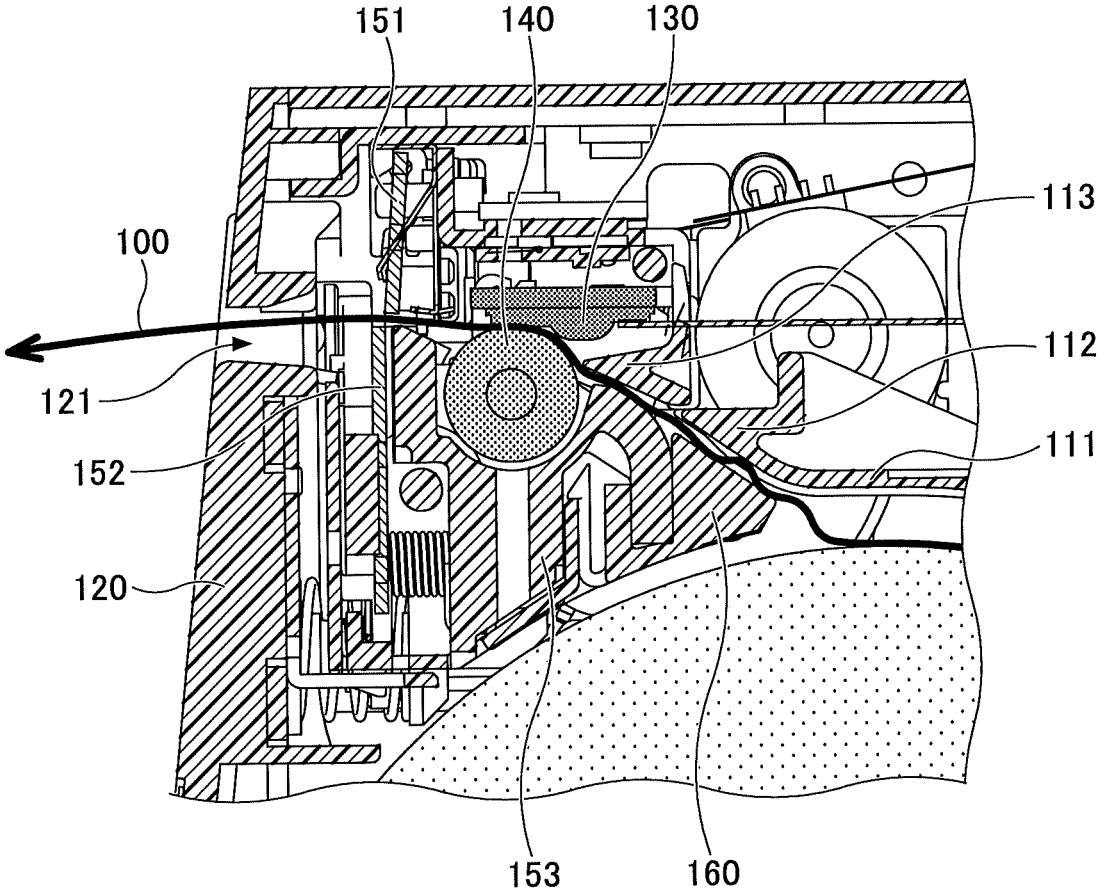
FIG. 17 is a drawing illustrating a path in the printer of the first embodiment through which recording paper is conveyed.
Figure 18:
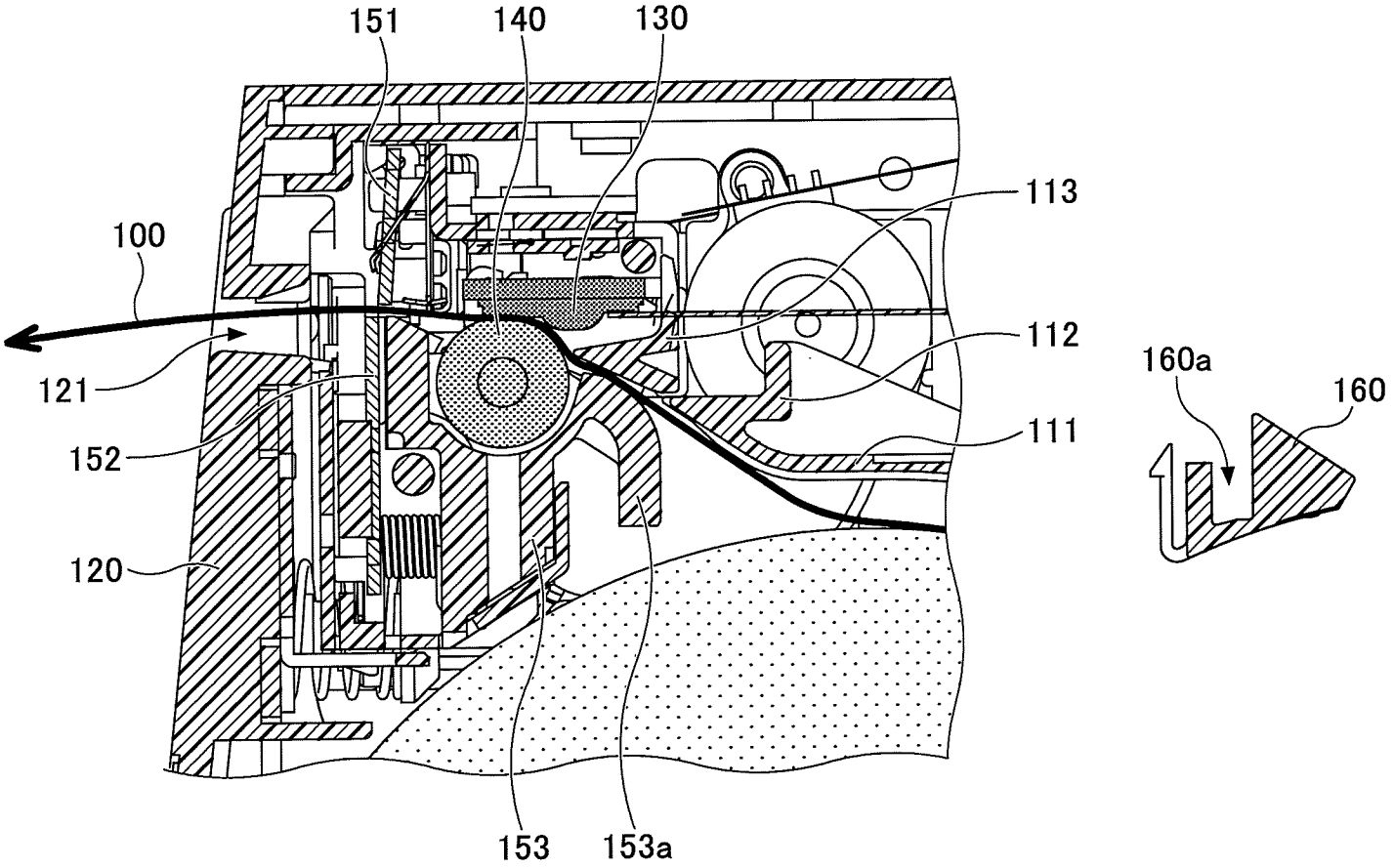
FIG. 18 is a drawing illustrating another configuration of a printer according to the first embodiment.

In the first embodiment, the lower guide 160 is formed of a resin material. However, the lower guide 160 may also be formed of a metal material such as stainless steel. The lower guide 160 may be formed in a shape as illustrated in FIG. and may be configured to be detachably attachable to the cutter frame 153. More specifically, as illustrated in FIG. 18, a recess 160*a* may be formed in the middle of the lower guide 160. In this case, the lower guide 160 is attached to the cutter frame 153 by fitting together the recess 160*a* and a protruding part 153*a* of the cutter frame 153 facing the holder guide 112. Also, a part with an arrow-shaped end is formed to the left of the recess 160*a* of the lower guide 160. As illustrated in, for example, FIG. 17, this part engages with the cutter frame 153 and prevents the lower guide 160 from being detached from the cutter frame 153.

In the printer with a configuration where the recording paper 100 is placed in the recording-paper holder 111 using a drop-in mechanism, the outer layer of the rolled recording paper 100 tends to rewind and warp. Also for this reason, it is preferable to provide the lower guide 160 in the printer.

Figure 19:
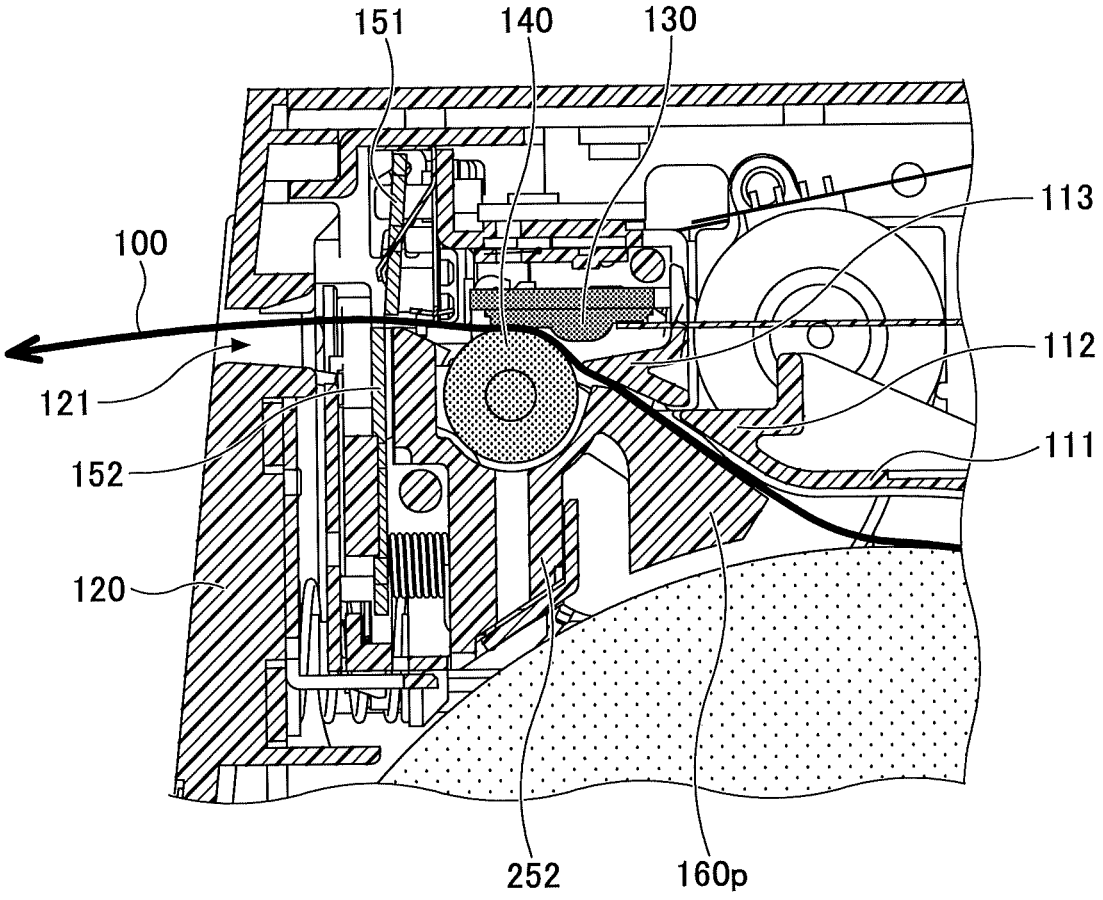
FIG. 19 is a drawing illustrating another configuration of a printer according to the first embodiment.

Also, as illustrated in FIG. 19, a lower guide and a cutter frame may be formed as a monolithic part using the same material. A cutter frame 252 in FIG. 19 includes a lower guide 160*p* that corresponds to the lower guide 160 and is formed as a part of the cutter frame 252.

Figure 20:
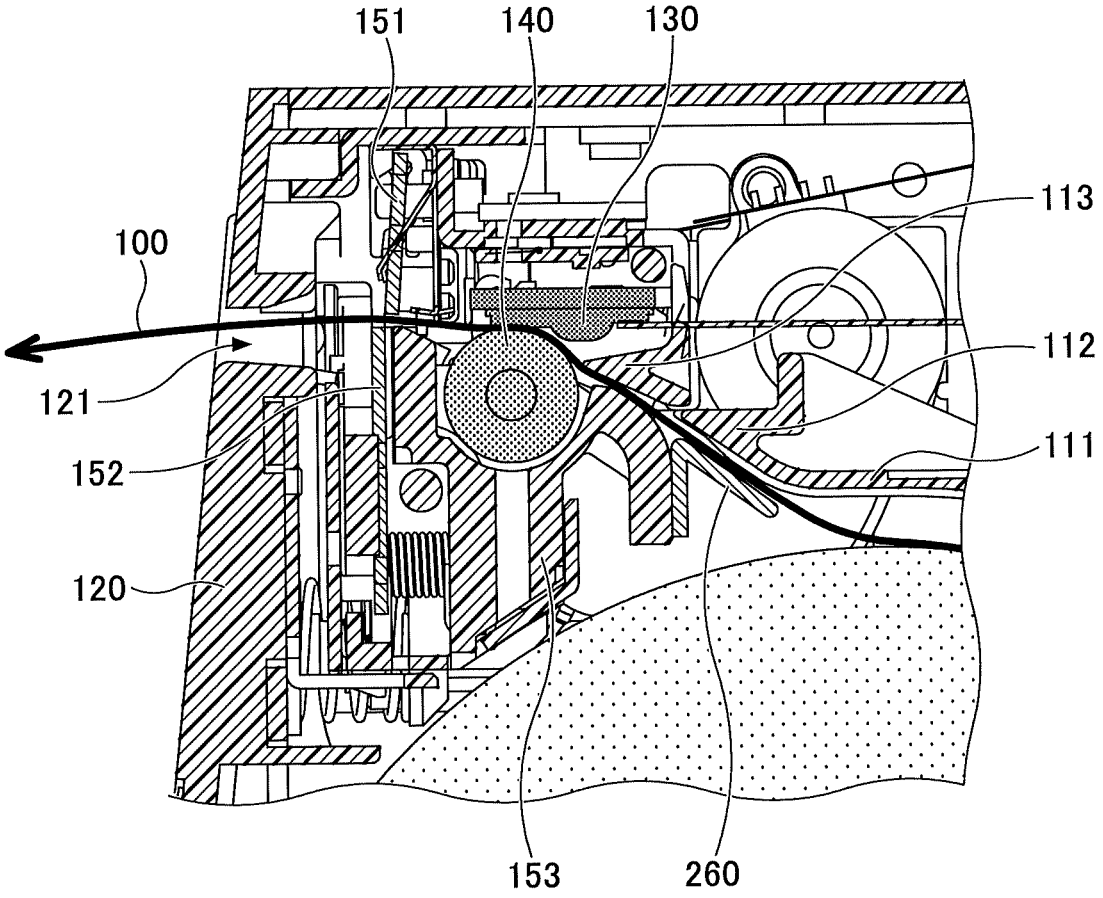
FIG. 20 is a drawing illustrating another configuration of a printer according to the first embodiment.

Further, a lower guide 260 illustrated in FIG. 20 may be used in place of the lower guide 160. The lower guide 260 may be formed, for example, by bending a metal plate made of stainless steel, by zinc die-casting, or by aluminum die-casting.

Second Embodiment

Next, a printer according to a second embodiment is described.

Figure 21:
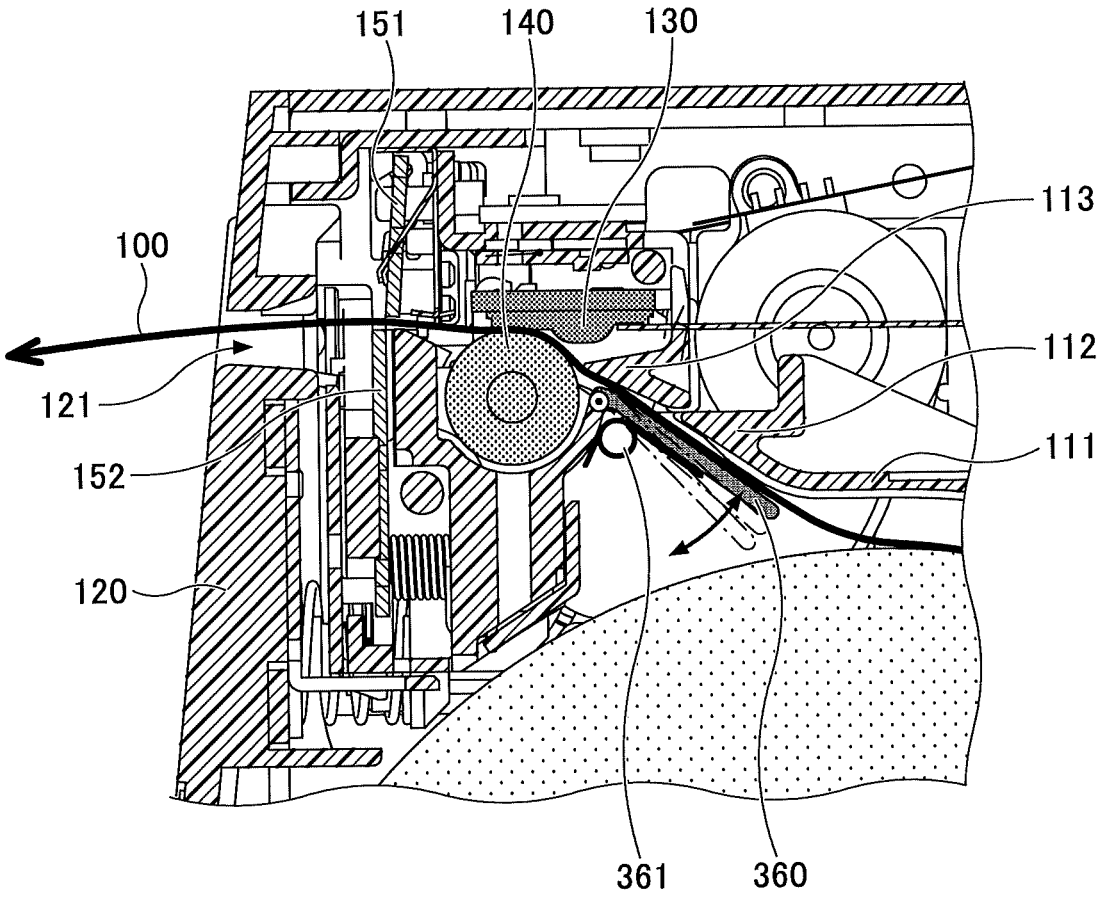
FIG. 21 is a drawing illustrating a configuration of a printer according to a second embodiment.

As illustrated in FIG. 21, the printer of the second embodiment includes a lower guide 360 and a coil spring 361 that presses the lower guide 360 toward the holder guide 112. Other components of the printer of the second embodiment are substantially the same as those described in the first embodiment. The recording paper 100 passes between the holder guide 112 and the lower guide 360. Because the lower guide 360 is pressed by the force of the coil spring 361 toward the holder guide 112, the recording paper 100 is sandwiched between the holder guide 112 and the lower guide 360. This configuration makes it possible to prevent the recording paper 100 from warping and being jammed in a conveying path extending from a position between the thermal head 130 and the platen roller 140 to a position between the holder guide 112 and the lower guide 360. In the second embodiment, the lower guide 360 may be formed of a resin material or a metal material.

Figure 22:
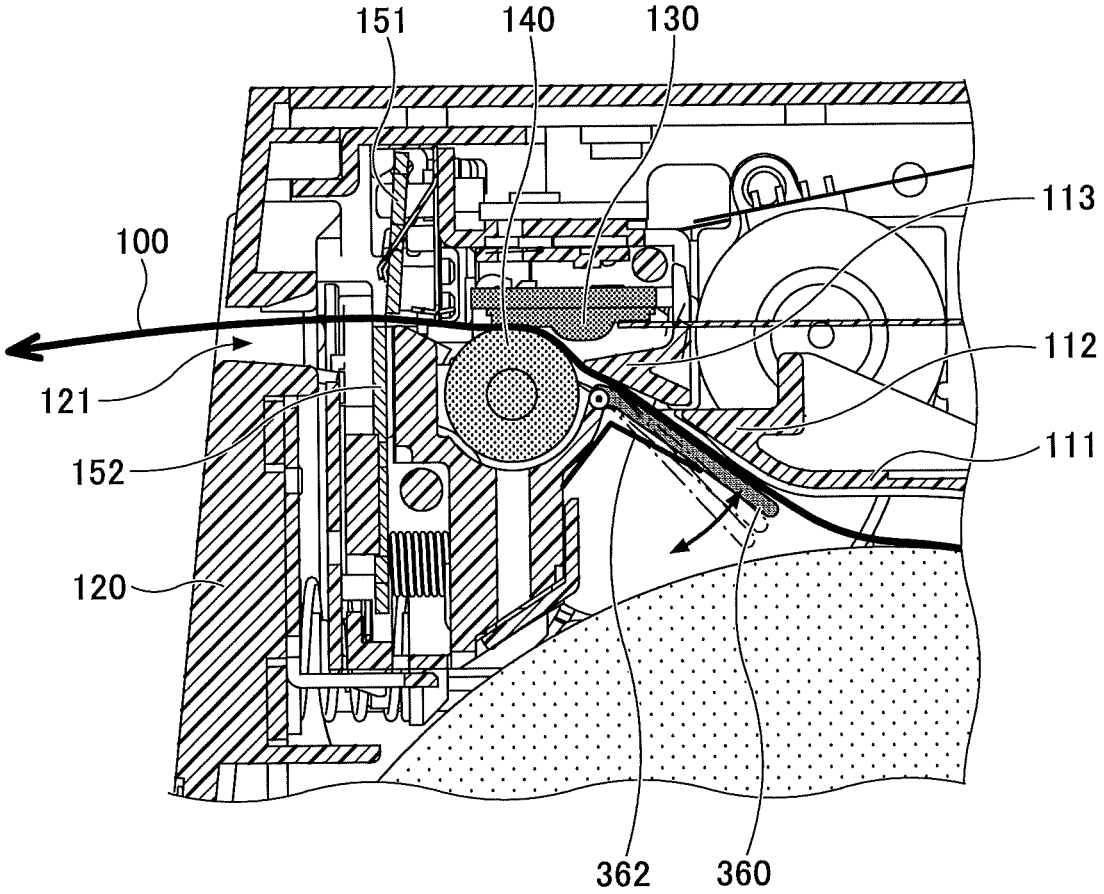
FIG. 22 is a drawing illustrating another configuration of a printer according to the second embodiment.

In the printer of the second embodiment, a plate spring 362 illustrated in FIG. 22 may be used in place of the coil spring 361. Also, instead of the coil spring 361 and the plate spring 362, other types of elastic bodies such as rubber may be used to bias the lower guide 360.

Figure 23:
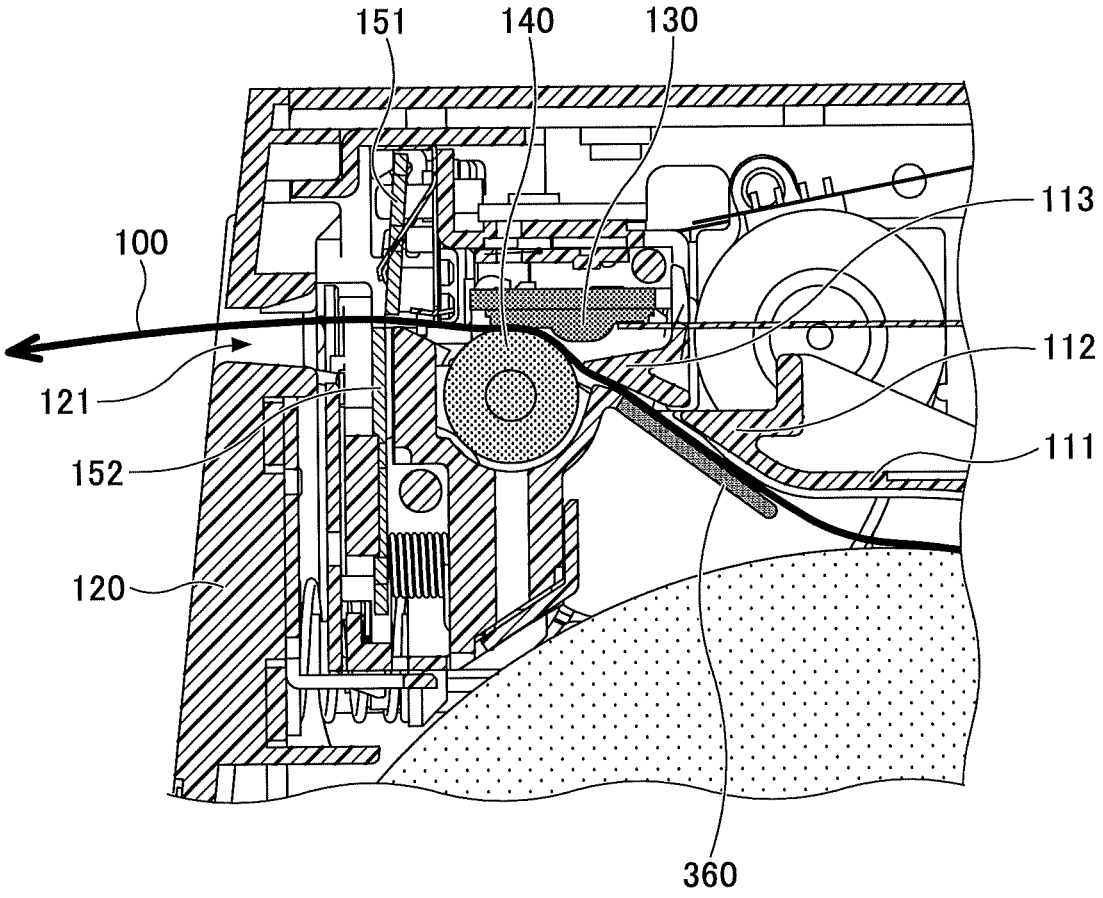
FIG. 23 is a drawing illustrating another configuration of a printer according to the second embodiment.

In the printer of the second embodiment, as illustrated in FIG. 23, the lower guide 360 itself may have elasticity to press the recording paper 100 toward the holder guide 112. In this case, the coil spring 361 in FIG. 21 and the plate spring 362 in FIG. 22 are not necessary.

A printer according to embodiments of the present invention is described above. However, the present invention is not limited to the above-described embodiments.

The present application is based on and claims the benefit of priority of Japanese Patent Application No. 2015-177970 filed on Sep. 9, 2015, the entire contents of which are hereby incorporated herein by reference.

EXPLANATION OF REFERENCE NUMERALS

100 Recording paper
110 Printer body
111 Recording-paper holder
112 Holder guide
113 Upper guide
115 Control circuit board
120 Cover
121 Paper-ejection port
130 Thermal head
140 Platen roller
151 Fixed blade
152 Movable blade
153, 252 Cutter frame
160, 160*p*, 260, 360 Lower guide
361 Coil spring
362 Plate spring

The invention claimed is:

1. A printer, comprising:

a printer body including a recording-paper holder that holds rolled recording paper, the recording-paper holder including a holder guide for guiding the recording paper;

a cover that is pivotally openable relative to the printer body;

a cutter frame provided on the cover and including a movable blade and a protruding part that protrudes toward the holder guide, the cutter frame being disposed to face the holder guide;

a platen roller provided on the cover;

a print head attached to the printer body; and a lower guide that is attached to the cutter frame and disposed upstream of the cutter frame in a direction in which the recording paper is fed, the lower guide being disposed to face the holder guide, wherein a conveying path for guiding the recording paper toward the platen roller and the print head is formed between the lower guide and the holder guide and between the cutter frame and the holder guide, and wherein the lower guide includes a recess in which the protruding part fits, thereby being detachably attached to the cutter frame.

2. The printer as claimed in claim 1, wherein the lower guide and the cutter frame are formed as a monolithic part.

3. The printer as claimed in claim 1, wherein the lower guide is configured to press the recording paper toward the holder guide.

4. A printer, comprising:

a printer body including a recording-paper holder that holds rolled recording paper, the recording-paper holder including a holder guide for guiding the recording paper;

a platen roller;

a cover that is pivotally openable relative to the printer body;

a cutter frame provided on the cover and including a movable blade and a protruding part that protrudes toward the holder guide;

a platen roller provided on the cover;

a print head attached to the printer body;

a lower guide that is attached to the cutter frame and disposed to face the holder guide; and an upper guide that is provided on the printer body and disposed to face the cutter frame, wherein the printer is configured such that the recording paper fed from the recording-paper holder passes between the lower guide and the holder guide, passes between the upper guide and the cutter frame, and is then fed toward the platen roller and the print head, and wherein the lower guide includes a recess in which the protruding part fits, thereby being detachably attached to the cutter frame.

5. The printer as claimed in claim 1, wherein the recording-paper holder and the holder guide are formed as a monolithic part; and the lower guide is disposed lower than the holder guide.

6. The printer as claimed in claim 4, wherein the upper guide is disposed next to the holder guide and upstream of the platen roller and the print head in a direction in which the recording paper is conveyed.

* * * * *